United States Patent [19]

Maddox

[11] 4,395,344

[45] Jul. 26, 1983

[54] DRAIN OPENER COMPOSITION

[75] Inventor: Lodric L. Maddox, Oakland, Calif.

[73] Assignee: The Clorox Company, Oakland, Calif.

[21] Appl. No.: 709,652

[22] Filed: Jul. 29, 1976

Related U.S. Application Data

[63] Continuation of Ser. No. 361,882, May 21, 1973, abandoned.

[51] Int. Cl.[3] ..... C11D 7/54

[52] U.S. Cl. ..... 252/99; 252/94; 252/95; 252/103; 252/156; 252/186.3; 134/2

[58] Field of Search ..... 252/99, 103, 94, 95, 252/156, 186.3; 134/2

[56] References Cited

U.S. PATENT DOCUMENTS 1,129,056 2/1915 Anhgltzov ..... 251/157 X 3,156,654 11/1964 Komecny et al. ..... 252/99 X 3,168,478 2/1965 Stefeik ..... 252/156 X 3,532,634 10/1970 Woods ..... 252/99 X 3,697,431 10/1972 Summerfelt ..... 252/103 X

*Primary Examiner*—Irwin Gluck

*Attorney, Agent, or Firm*—Majestic, Gallagher, Parsons & Siebert

[57] ABSTRACT

A drain opening composition having superior ability to thoroughly and uniformly mix with the contents of a drain whereby any drainage constriction is attacked by the components of the composition to ensure free flow within the drain. The composition contains strong caustic in combination with an oxygen gas producing peroxy compound, particulate aluminum, potassium salts, a catalyst to promote the gas-forming reaction and a surfactant.

17 Claims, No Drawings

DRAIN OPENER COMPOSITION

This is a continuation, of Ser. No. 361,882, filed May 21, 1973, now abandoned.

BACKGROUND OF THE INVENTION

Drain opening compositions in both the solid and liquid form are well known in the art. The solid forms are almost universally based upon strong caustics that generate heat upon addition to water in order to liquify fats and greases and to dissolve hair and soap curd most usually responsible for plugging up the drain. In addition the strong caustic attacks mold slime, food particles and the like to further aid in opening the drain.

The liquid forms are based upon either strong caustics or strong acids and also contain strong oxidizing agents. However these liquid compositions upon addition to water are not capable of generating enough heat to liquify fats and greases as they have little or no heat of solution remaining due to the diluted form in which they are marketed. Consumer safety regulations prevent increase in solution concentrations.

Although such prior art compositions have the ability to remove or dissolve many drain constrictions, a major problem with all such opener compositions is achieving physical and chemical contact between the constriction itself and the drain opener composition. For if actual contact cannot be achieved, the clearing action of the composition is greatly diluted or weakened, and the desired results, i.e., removal of the constrictions, are not achieved.

In this regard, both the physical layout of the drain trap and the type of drain opener are principally to blame. All such traps are in the shape of a U wherein one of the arms is bent over at right angles on the downstream side thus: $\left.\right|_{U}$. If a constriction occurs on the side of the upright arm, that is, the side open to the sink, tub, etc., there is little difficulty in achieving actual contact between the constriction and the opener composition. Similarly, it is frequently easy to achieve contact where the constriction occurs at the bottom of the U, since the opener composition (being heavier than water) will naturally gravitate to the lowest position in the drain. However, in such instances, the use of solid drain openers results in high localized concentrations of caustic which tend to salt out the saponified fatty acids thereby reforming flow barriers and thus the constriction continues. Further, liquid opener compositions are diluted by the water present so as to decrease their immediate effectiveness.

The greater difficulties result when the constriction occurs beyond the bottom of the U, i.e., at some point in the bent arm, and especially immediately before, at, or beyond (downstream) the right angled bend. Physical or chemical contact with such constrictions is especially difficult to achieve since the prior art formulations are heavier than water and therefore tend to remain at the bottom of the U and further are incapable of displacing or mixing with the water trapped between the drain opener composition and the blockage to any appreciable extent.

In order to overcome this difficulty, compositions have been devised which attempt to achieve mixing with the water trapped within the drain. Typically, formulations have been devised that release a gas upon contact with water in the hope that the gas bubbles will force mixing of the drain opener composition with the trapped water. The most well known of solid drain opener compositions contains a strong caustic and aluminum particles, which, in the presence of water, releases hydrogen gas. Studies have indicated that these commercially available compositions are generally quite feeble in achieving a thorough mixing of the opener composition with the water trapped in the drain, especially where the constrictions are in the bent arm portion. These compositions are also known to form an insoluble "caustic heel" in the bottom of the U if the aluminum is not included in the composition or if the first attempt to open the drain is unsuccessful and successive applications of an aluminum containing composition are placed therein.

BRIEF DESCRIPTION OF THE INVENTION

The present invention relates to an improved drain opening composition and more particularly to a drain opening composition that releases oxygen gas over an extended period of time to effect thorough and uniform mixing of the components of the composition with the water contained in the drain.

In brief, the drain opener composition of the invention comprises a major proportion of a strong caustic such as sodium hydroxide, a minor amount of aluminum metal, several potassium salts, a peroxy compound such as for instance sodium perborate and minor amounts of a catalyst and a surfactant.

It is an object of this invention to provide a drain opening composition having a superior ability to mix with the water trapped in a clogged drain.

It is another object of this invention to provide a drain opening composition that evolves oxygen gas over an extended period of time upon contact with water.

It is a further object of this invention to provide a drain opening composition that utilizes principally oxygen gas in order to effect thorough and uniform mixing of the composition components with the water trapped in a drain.

It is yet another object of this invention to provide a drain opening composition including perborate compounds therein.

It is still another object of this invention to provide a drain opening composition that is particularly effective in opening drains wherein the obstructing plug occurs in the vicinity of the bent arm portion of the trap.

Other objects and advantages of the invention will become apparent upon a review of the following specification and claims appended hereto.

DETAILED DESCRIPTION OF THE INVENTION

The composition of the instant invention comprises principally a caustic alkali in combination with additional components which serve the purpose of (1) providing potassium ions for the purpose of forming soft soluble soaps with the greases and fats that normally comprise a major component of the constriction; (2) a surface active agent; (3) gas forming or gas promoting components that generate gases, the gases being utilized to effect thorough and uniform mixing of the other components in the composition; and (4) a catalyst to promote the evolution of gas when the composition is contacted with water.

The principal component of the composition is a strong aggressive caustic, preferably sodium hydroxide which may be present in the form of small particles such as pellets, flakes or the like. The sodium hydroxide may be a commercial grade thereof which is universally available in commerce. The sodium hydroxide comprises the major component of the drain opening composition being present to an extent of greater than 50% by weight. This strong caustic serves several purposes in the composition. Firstly, it produces a considerable amount of heat upon dissolution in water, the heat of solution favoring the melting and liquification in localized areas of the greases and fats which most often form a major component of the plugs that clog drains. Secondly, it reacts chemically to saponify fats to soaps which, in turn, act as emulsifying agents to remove and dissolve other fats and greases. In addition, the strong caustic attacks protein materials such as hair, which quite often form a portion of the plugging material. Further, carbohydrate containing materials such as paper, food particles, cotton fabrics, sponge, etc., react with caustic to become limp or flexible, or even dissolve therein.

A second component of the drain opening composition comprises aluminum metal usually in the form of shot, chips, turnings or the like and being present in an amount of somewhat less than 5% by weight of the drain opening composition. The aluminum particles serve the same purpose as the aluminum that has been found present in prior art compositions, i.e., upon contact with water, the aluminum in the presence of a strong caustic generates hydrogen gas which is effective in preventing "caustic heel" formation in the trap area of the drain.

The third component of the drain opening composition of the invention consists of a peroxy compound, preferably sodium perborate monohydrate. This component comprises somewhat less than 10% by weight of the drain opening composition and is present therein for the purpose of generating oxygen gas over an extended period of time after the drain opening composition has been mixed with the water trapped in the drain. Other compounds which generate oxygen upon contact with water are also suitable for use in the place of the sodium perborate. For instance, percarbonate or perphosphate compounds may be substituted for the perborate. However, the perborate composition is preferred for use in the present invention.

The fourth component of the drain opening composition of the invention comprises potassium salts that are present in appreciable amounts aggregating as much as 35% by weight of the total composition. A combination of potassium salts is preferred, particularly potassium chloride and potassium nitrate. Both of these salts are readily soluble in water and upon such solution furnish an appreciable quantity of potassium ion. The presence of potassium ion is highly desirable since these ions, upon contact with the saponified fats and greases, produce soft, highly soluble soaps which easily dissolve in the drain water thus helping to break-up and remove other substances often contributing to the constriction.

The fifth component of the drain opening composition of the invention consists of a catalyst whose function is to assist and promote in the gas generation when the drain opening composition is contacted with water. Preferably a heavy metal salt such as cobalt carbonate in an amount of somewhat less than one-half of 1% is in the drain opening composition. A number of other salts such as those of copper, iron, nickel, silver and manganese are also useful in catalyzing the production of the gases necessary to effect mixing when the drain opening composition is contacted with water. Cobalt carbonate, however, has been found to be particularly effective for this purpose.

The sixth and final component of the drain opening composition of the invention comprises a surface-active agent whose function is not entirely understood, but it is presumed that it promotes "wetting" of the surfaces within the drain and further assists in dissolving the fats and greases normally forming a portion thereof. In this regard, an anionic surfactant such as an alkyl phosphate ester of the type that is stable in a highly caustic environment in a concentration of approximately 0.01% by weight of the composition has been found to be effective. These preferred phosphate ester surfactants are commercially available from, for example, the General Aniline & Film Corporation of New York, N.Y. These surfactants are extremely stable in strong alkaline solutions and in addition have an excellent detergency.

A typical formulation of the drain opening composition of the invention is as follows:

| Component | Approximate Percent By Weight |
|---|---|
| Aluminum Metal | 2.5 |
| Sodium Hydroxide | 61.3 |
| Cobalt Carbonate | 0.14 |
| Anionic Phosphate Ester Surfactant | 0.01 |
| Sodium Perborate Monohydrate | 9.3 |
| Potassium Chloride | 20.85 |
| Potassium Nitrate | 5.9 |

The percentages of the components of the composition are set forth above, are only approximate, but they are in the preferred range of percentages. Some variation in relative amount of the various components may be made without adversely interfering with the effectiveness of the drain opening composition.

It should be recognized that the perborate component of the drain opening composition tends to be rather unstable especially in the presence of strong caustic. It has therefore been found advantageous to package the drain opening composition of the invention in two compartments. Segregating the components prior to use increases the shelf life thereof to an acceptable length and does not interfere with the use of the composition since it is only necessary to pour both parts of the composition into the drain orifice simultaneously in order to produce an effective action. More specifically, it has been found advantageous to package the aluminum, sodium hydroxide, catalyst and surface active agent in one container while the sodium perborate and potassium salts are packaged in a second container. In use, of course, the two containers of the segregated components of the composition are combined as they are poured into the drain and the effective mixing and dissolving action occurs thereafter.

In use the drain opening composition, which is packaged as a dry granulated or powdered material, is poured directly into the water that is left standing in a drain, whether obstructed or open. The composition is poured directly into the drain opening so that the particles will sink towards the bottom of the U-trap. As the components mix with the water standing in the clogged drain hydrogen gas is generated from the action of the aluminum metal in the presence of the strong caustic and water. Additionally oxygen is generated from the perborate compound also in the presence of the strong caustic and water. The evolution of these gases, and more particularly, the oxygen gas, produces a strong churning and mixing action within the drain. The generation of oxygen gas from the decomposition of the perborate continues at a rapid rate for an extended period of time, i.e., up to 20 minutes or longer.

It has been found that this prolonged evolution of oxygen within the drain produces a complete mixing of the drain opener composition components with the water that is left standing therein. Tests have revealed that not only are the drain opener composition components thoroughly and uniformly mixed with the water standing in the sink side of the drain trap U, but in addition, the drain opener components are thoroughly and uniformly mixed with the water standing in the sewer side of the U. This thorough mixing of the drain opener composition components is particularly effective in attacking plugs that occur on the downstream side of the drain trap.

The relative effectiveness of the composition of the present invention as compared with a typical heat generating prior art product comprising aluminum metal, sodium nitrate, sodium hydroxide and a catalyst was tested as follows:

A sink basin with a 7 inch tailpiece extension was hooked to a standard P-trap. The downstream end of the P-trap was fitted to a 9 inch pipe extension. Throughout the drain system nine holes were bored and fitted with elastomeric septums. Hypodermic needles were inserted as required into the septums to withdraw samples at the various positions on the drainpipe extensions. Sampling points A, B and C were positioned approximately equally distant in sequence from the drainpipe junction with the sink downwardly to the bottom of the P-trap. Sampling position D coincided with the bottom of the P-trap. Sampling position E was approximately midway between the bottom of the P-trap and the right-angled bend of the P-trap as it extended towards the sewer line. Sampling position F was directly at the right-angled bend of the P-trap while sampling positions G, H and I were equally spaced in sequence between the right-angled bend of the P-trap and a rubber stopper which was inserted into the exit or sewer end of the extension pipe. Sampling Point I was immediately adjacent this rubber stopper which served to simulate a fully clogged drain.

796 milliliters of water were added to the sink to fill the pipe level with the drain opening. Air was removed from the pipe system to insure uniformity for each test before adding the drain opening product. Equivalent quantities (sufficient to produce a concentration of 3–6% sodium hydroxide upon thorough mixing with the drain water) of the drain opener composition of the present invention and the prior art drain opener composition were introduced into the center of the drain orifice at the bottom of the sink. This procedure was repeated for every test.

Samples from the various positions on the drain were withdrawn after 1 minute, 2 minutes, 3 minutes, 5 minutes and 15 minutes for each composition. These samples were then analyzed and the sodium hydroxide concentration therein was calculated. Results of these tests were as follows:

| | % Concentration of Sodium Hydroxide | | | | | |
|---|---|---|---|---|---|---|
| Blank Av. - 0.03 | | | | | | |
| | TIME: | | | | | |
| Sample: | 1 MIN. | (1)→ 2 MIN. | → 3 MIN. | → 5 MIN. | | 15 MIN. |
| Composition of the invention | | | | | | |
| A | 2.51 | 2.55 | 3.03 | 3.50, | 3.47 | 3.37 |
| B | 2.22 | 2.64 | 3.10 | 3.64, | 3.54 | 3.37 |
| C | 2.36 | 2.75 | 3.25 | 3.77, | 3.68 | 3.37 |
| D | 2.46 | 3.35 | 3.94 | 4.14, | 3.97 | 3.37 |
| E | 2.70 | 3.18 | 3.98 | 4.26, | 3.95 | 3.43 |
| F | 1.22 | 3.14 | 3.91 | * | 3.89 | 3.41 |
| G | * | 1.94 | * | * | * | 3.43 |
| H | * | 2.65 | * | 2.05, | 2.70 | 3.51 |
| I | * | 2.98 | 1.88 | 3.05, | 3.50 | 3.49 |
| Prior Art Composition | | | | | | |
| A | 0.67 | 0.62 | 0.66 | 1.27, | 1.19 | 1.22 |
| B | 0.68 | 0.63 | 0.67 | 1.31, | 1.21 | 1.21 |
| C | 0.70 | 0.64 | 0.66 | 1.33, | 1.21 | 1.21 |
| D | 1.12 | 0.68 | 0.78 | 1.34, | 3.64 | 3.82 |
| E | 0.01 | 0.02 | 0.00 | 0.05, | 0.03 | 0.09 |
| F | 0.02 | 0.00 | 0.00 | 0.04, | 0.03 | 0.07 |
| G | * | * | * | 0.01 | * | 0.08 |
| H | 0.00 | 0.00 | 0.00 | 0.01, | 0.01 | 0.07 |
| I | 0.00 | 0.00 | 0.00 | 0.01, | 0.01 | 0.07 |

(1)Time needed to effectively distribute composition of the invention: 2 to 5 minutes.
*Inadequate amount of sample available due to presence of gas/foam.

From the above data is will be readily apparent that in a drain system completely plugged on the sewer side of the trap, the composition of the present invention was evenly distributed up to the very point of the plug within 2–5 minutes. In a similar time period, and even within 15 minutes, the prior art drain opening composition was essentially absent from all points in the drain downstream of the bottom of the U (sampling point D). Thus the prior art composition was entirely ineffective in mixing with the trapped drain water at any point downstream from the bottom of the U and thus it must be concluded that such prior art composition would be ineffective in removing a plug in any such position in the drain. On the other hand, the composition of the invention appears to fully mix with the trapped drain water right up to the very site of the plug in a short period of time.

It is to be understood that this invention is not to be limited to the exact details of operation or exact compositions shown and described since obvious modifications and equivalents will be apparent to one skilled in the art, and the invention is therefore to be limited only by the scope of the claims appended hereto.

I claim:

1. A drain opener composition that provides improved mixing with liquids trapped within a plugged drain, comprising a strong caustic in an amount of greater than about 50% by weight of the composition, aluminum metal in an effective amount for producing hydrogen gas in the presence of said caustic and for causing a mixing action, said effective amount of aluminum metal comprising less than about 5% by weight of the composition, a peroxy compound suitable for the process of generating oxygen gas over an extended period of time in an effective amount for generating oxygen gas to produce a strong mixing action, said amount of said peroxy compound comprising less than about 10% by weight of composition, a heavy metal salt catalyst in an amount sufficient for promoting the evolution of oxygen from said peroxy compound in the presence of water and the strong caustic, a surfactant which is stable in a highly caustic environment, and a water soluble potassium salt other than said surfactant, said potassium salt producing potassium ions in water solution, said ions upon contact with saponified fats and greases in said drain producing soft, highly soluble soaps which easily dissolve in drain water.

2. The composition of claim 1 wherein said strong caustic is sodium hydroxide.

3. The composition of claim 1 wherein the peroxy compound is a perborate.

4. The composition of claim 3 wherein the perborate is sodium perborate monohydrate.

5. The composition of claim 4 wherein the sodium perborate monohydrate is present in an amount of about 7 to about 8% by weight.

6. The composition of claim 1 wherein the aluminum metal is present as particles and comprises about 3% by weight of the composition.

7. The composition of claim 1 wherein said catalyst is cobalt carbonate.

8. The composition of claim 7 wherein the catalyst is present in an amount of about 0.3% by weight in the composition.

9. The composition of claim 1 wherein the surfactant is an anionic alkyl phosphate ester surfactant.

10. The composition of claim 9 wherein the surfactant is present in an amount of about 0.01% by weight in the composition.

11. The composition of claim 1 wherein the potassium salts are a mixture of potassium chloride and potassium nitrate.

12. The composition of claim 11 wherein the potassium chloride is present in an amount of about 18% to about 21% by weight and the potassium nitrate is present in an amount of about 5% to about 17% by weight.

13. A drain opener composition comprising by weight about 54 to 62% sodium hydroxide, about 3% aluminum metal, about 0.1 to 0.3% cobalt carbonate, about 0.01% of an anionic alkyl phosphate ester surfactant, about 7 to 10% of sodium perborate-monohydrate, about 18 to 21% potassium chloride, and about 5 to 17% potassium nitrate.

14. The composition of claim 1 wherein the components of the composition are packaged into two portions, the first portion including the strong caustic, aluminum metal, the catalyst and the surfactant, and the second portion including the peroxy compound and the postassium salts.

15. A composition as in claim 1, wherein said peroxy compound in the presence of said catalyst, said water and said strong caustic evolves said oxygen from said peroxy compound for an extended period of time for at least about 20 minutes.

16. A composition as in claim 1, wherein said peroxy compound is selected from the group consisting of a perborate, a percarbonate and a perphosphate.

17. A drain opener composition that provides improved mixing with liquids trapped within a plugged drain, comprising sodium hydroxide in an amount greater than about 50% by weight of the composition, aluminum metal in an effective amount for producing hydrogen gas in the presence of said sodium hydroxide and for causing a mixing action, said effective amount of aluminum metal comprising less than about 5% by weight of the composition, sodium perborate monohydrate in an effective amount for generating oxygen gas for an extended period of time of at least about 20 minutes, said effective amount of the sodium perborate monohydrate comprising about 7 to about 10% by weight of composition, a heavy metal salt catalyst in an amount sufficient for promoting the evolution of oxygen from the sodium perborate monohydrate in the presence of water and the sodium hydroxide, a surfactant which is stable in a highly caustic environment, and a water soluble potassium salt producing potassium ions in water solution, said ions upon contact with saponified fats and greases in said drain producing soft, highly soluble soaps which easily dissolve in drain water.

* * * * *